US008272509B1

(12) United States Patent
McCutchen

(10) Patent No.: US 8,272,509 B1
(45) Date of Patent: Sep. 25, 2012

(54) DIAMOND POLISHING PAD CADDY

(76) Inventor: David L. McCutchen, Sand Springs, OK (US)

( * ) Notice: Subject to any disclaimer, the term of this patent is extended or adjusted under 35 U.S.C. 154(b) by 0 days.

(21) Appl. No.: 13/333,336

(22) Filed: Dec. 21, 2011

Related U.S. Application Data

(63) Continuation of application No. 11/655,506, filed on Jan. 19, 2007, now Pat. No. 8,091,705.

(51) Int. Cl.
*B65D 83/04* (2006.01)

(52) U.S. Cl. ..... 206/486; 206/763

(58) Field of Classification Search ..... 206/763, 206/765, 443, 486, 490, 589, 526, 499; 451/28
See application file for complete search history.

(56) References Cited

U.S. PATENT DOCUMENTS 3,567,085 A * 3/1971 Flores ..... 224/604
4,166,537 A * 9/1979 Fortunato ..... 206/535
5,402,889 A * 4/1995 Hermann et al. ..... 206/443
6,109,446 A * 8/2000 Foote ..... 206/759
6,523,693 B1 2/2003 Eggenberger et al.
6,840,842 B2 * 1/2005 Hirai et al. ..... 451/28
6,971,513 B2 12/2005 Weinstein et al.
2005/0263430 A1 * 12/2005 Giovanni ..... 206/528

* cited by examiner

*Primary Examiner* — David Fidei
*Assistant Examiner* — Raven Collins
(74) *Attorney, Agent, or Firm* — Gable Gotwals

(57) ABSTRACT

A caddy for storing diamond polishing pads used by grinding machines holds multiple containers in a rack in a case. Each container is independently removable from the rack and case and stores a complete set of stacked pads so that sets of used pads are always sorted and accessible according to both their grit and wear characteristics. The case, rack and containers are configured with respect to the sets of pads and to each other so as to minimize their relative three dimensional motion during transport of the caddy. The case, rack and body of the containers are preferably made of cardboard so that many sets of pads can be stored and transported in one or more lightweight and inexpensive caddies.

18 Claims, 5 Drawing Sheets

DIAMOND POLISHING PAD CADDY

BACKGROUND OF THE INVENTION

This invention relates generally to grinding machines and more particularly concerns the storage of diamond polishing pads used in grinding machines.

Grinding machines, such as floor grinders, typically utilize sets of diamond polishing pads mounted in subsets on the machine. Each subset is orbited about its own axis and each pad of a subset is spun about its own axis. The pads consist of diamond chips suspended in a phenolic or metallic medium so that, as the pad spins and orbits on the surface to be polished, the medium is worn away and the diamond chips cut the surface. The grit of the pads is determined by the size of their diamond chips. The pads are removably attached to the machine, for example by screws or by mating segments of hook-and-loop material. The pads are replaced when they are worn out or whenever a different grit is required. Since the pads are relatively expensive, used pads which are not worn out are saved for future polishing tasks. In practice, this generally means that the pads are detached from the machine and tossed into a common storage bucket containing other pads of various grit and in various states of wear for retrieval when their grit is appropriate to a future task.

In the grinding process, the pads are spun and orbited at extremely high speeds. The more the grinding surfaces deviate from a common plane or from a plane parallel to the plane of balanced weight of the machine, the less control the operator has over the machine. Loss of control makes the task more difficult, increases the wear rate of the pads and may also result in damage to the surface being polished. Consequently, it is necessary for the operator to sort through the pads to find pads of the desired grit and then to assess the wear condition of those pads to assemble a set in which all of the pads are of substantially the same thickness. Grits may vary over a range extending from 12 to 3500 and it is not uncommon for multiple sets of pads in various states of wear for eight or more different grits to be collected in a common bucket. Since the pads are only in the order of ⅜" to ¾" thick to begin with, deviations can be difficult to see, even for operators with good vision. It is not uncommon for the sorting process to take 20 minutes or more and even a carefully selected set may not have a satisfactorily consistent thickness.

It is, therefore, an object of this invention to provide a caddy which stores used diamond polishing pads. Another object of this invention is to provide a caddy which eliminates the need for sorting used diamond polishing pads into matched sets. Yet another object of this invention is to provide a caddy which reduces the time spent in changing used diamond polishing pads on a grinding machine. It is a further object of this invention to provide a caddy which stores used diamond polishing pads in matched sets according to grit. Still another object of this invention is to provide a caddy which stores used diamond polishing pads in matched sets according to wear.

SUMMARY OF THE INVENTION

In accordance with the invention, a caddy is provided for diamond polishing pads used in grinding machines. A number of containers, each configured to contain a set of the pads in a stack; are held in a rack which defines a number of compartments, one compartment for each container. The compartments orient the containers in an array such that any one of the containers can be independently removed from the rack. A case configured to contain the rack with the containers oriented in their compartments has an open top through which any one of the containers can be independently removed from the rack and the case. A lid covers the open top of the case. A carrying handle is provided on a wall of the case.

In a preferred embodiment, each container is a tubular member of circular cross-section with a closed end, an open end and a cap covering the open end. A plug is used to close the lower end of the container. The height of each container is slightly greater than the height of an unused set of the stacked pads. One or more compressible disks can be stacked in the container with the set of pads so that the height of the stack will be at least equal to the height of the container and, therefore, fill the container when the cap is applied. The diameter of each container is slightly greater than the diameter of the pads. The rack has spaced-apart upper and lower trays with pairs of vertically aligned circular openings therethrough, one pair defining a compartment for each container. The case has a bottom wall, a front wall, a back wall, end walls and a hinged lid. The rack cooperates with the containers and the case to constrain the containers against Cartesian-directional motion in the case. The caddy rests on its bottom wall during storage but is rotated 90 degrees to orient a carrying handle on the case front wall to the top of the case during transport. The rack and case may each be formed from a single folded sheet of cardboard.

Thus, a complete set of stacked pads is stored in each container so that sets of used pads are always sorted and accessible according to both their grit and wear characteristics. The case, rack, containers and compressible disks, if used, are configured with respect to the sets of pads and to each other so as to minimize their relative three dimensional motion during transport of the caddy. The case, rack and body of the containers are preferably made of cardboard so that many sets of pads can be stored and transported in one or more lightweight and inexpensive caddies.

BRIEF DESCRIPTION OF THE DRAWINGS

Other objects and advantages of the invention will become apparent upon reading the following detailed description and upon reference to the drawings in which.

While the invention will be described in connection with a preferred embodiment thereof, it will be understood that it is not intended to limit the invention to that embodiment or to the details of the construction or arrangement of its parts.

DETAILED DESCRIPTION

Figure 2:
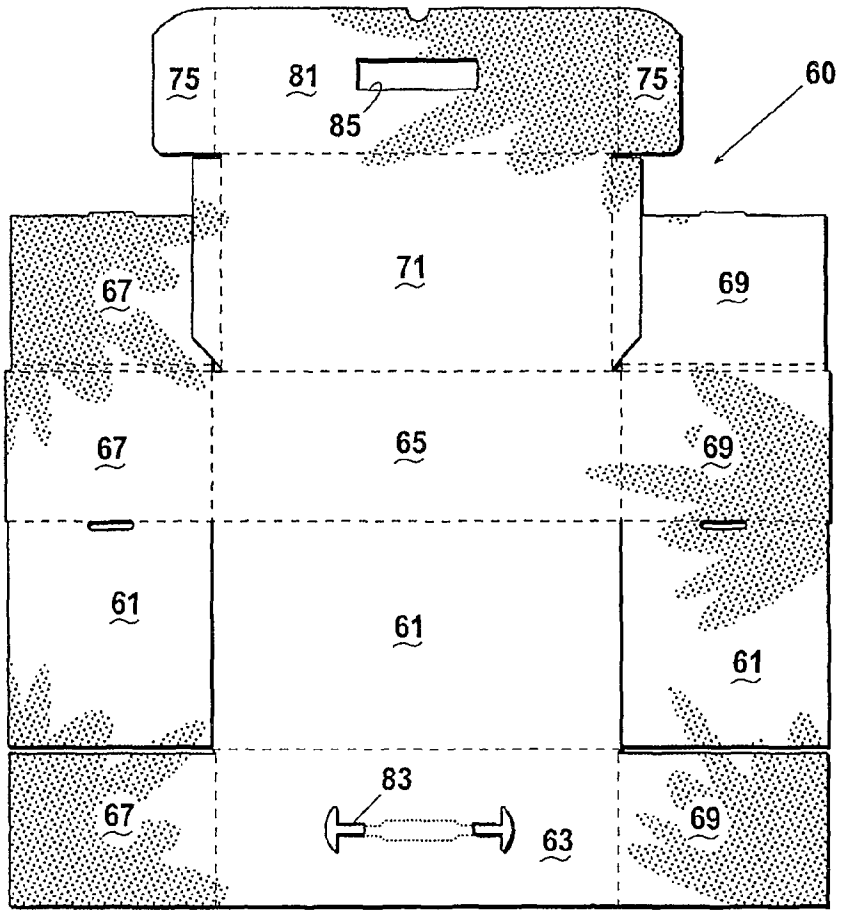
FIG. 2 is a plan view of a cardboard sheet foldable to form the case of the caddy.
Figure 1:
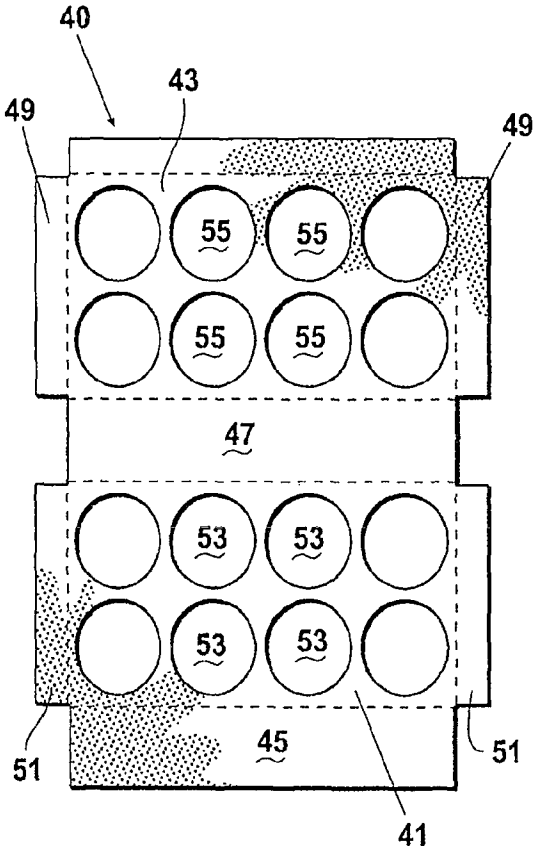
FIG. 1 is a plan view of a cardboard sheet foldable to form the rack of the caddy.
Figure 3:
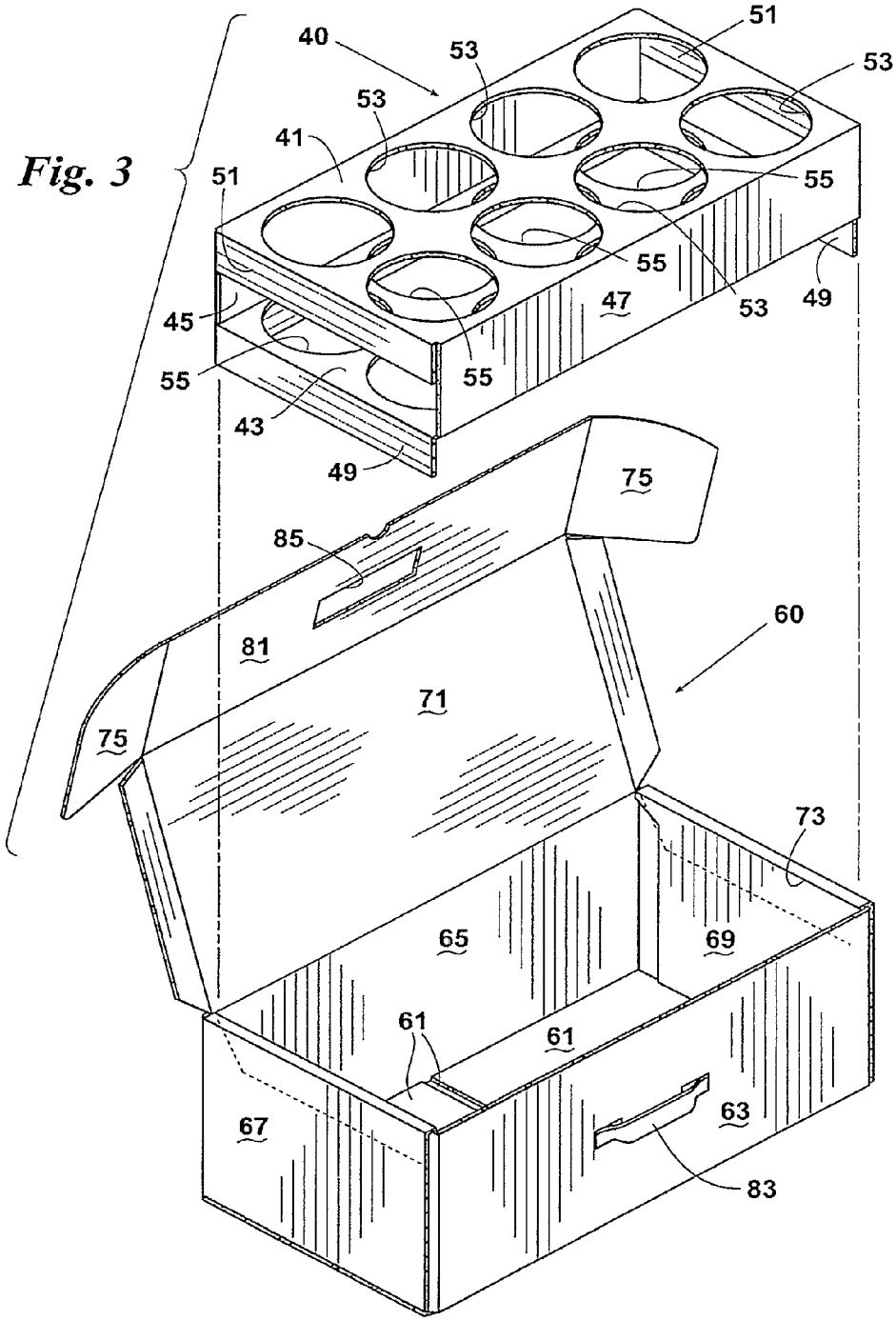
FIG. 3 is a perspective assembly view of the rack and case.
Figure 4:
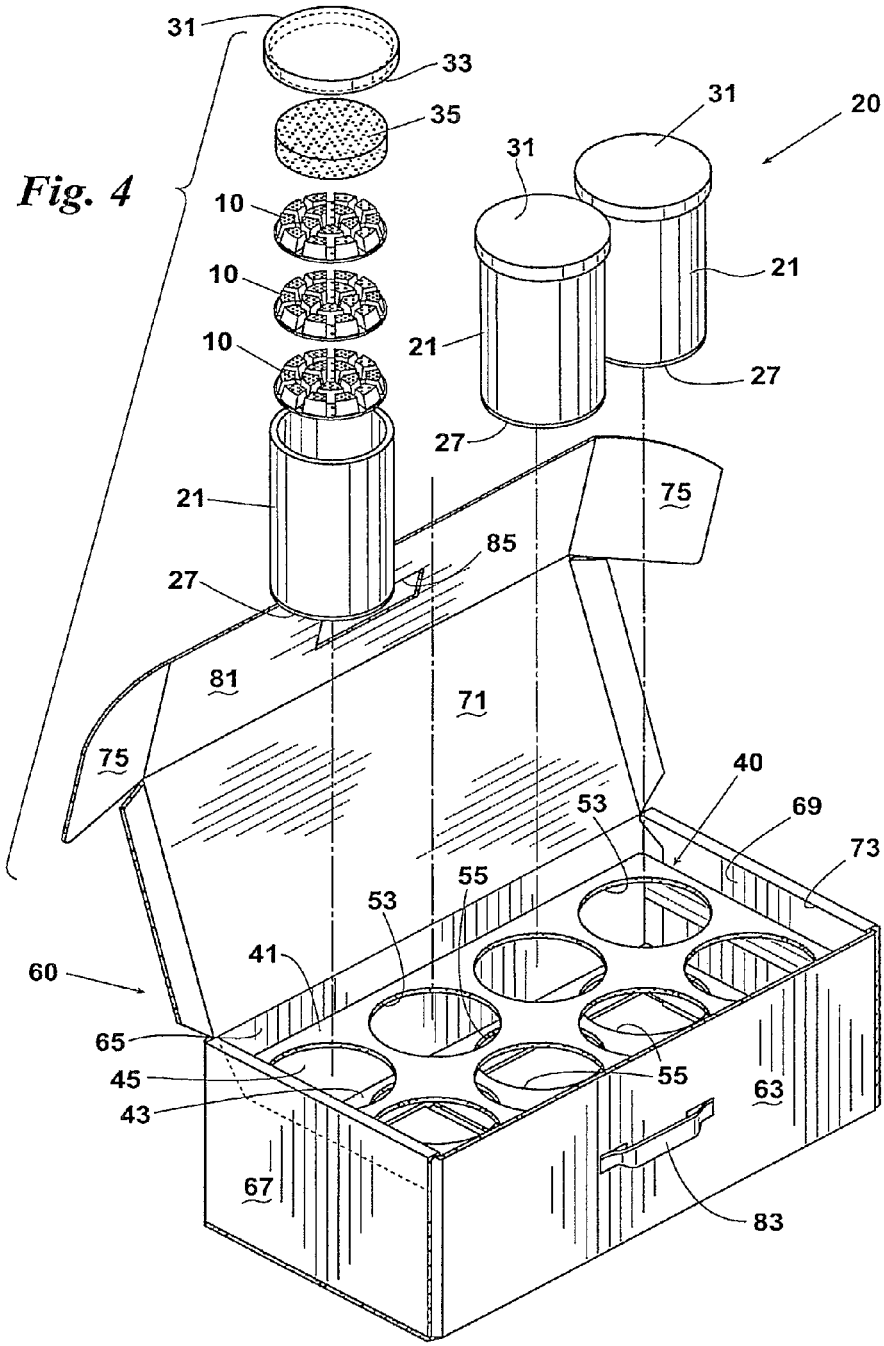
FIG. 4 is a perspective assembly view of the rack and case of the caddy assembled to receive the diamond polishing pads, filler disks and containers.

Looking first at FIG. 4, an embodiment of the caddy for storing and transporting sets of diamond polishing pads 10 used in grinding machines (not shown) is illustrated. The pads 10 are stored in containers 20 which are oriented in a rack 40 in the case 60 of the caddy.

Figure 7:
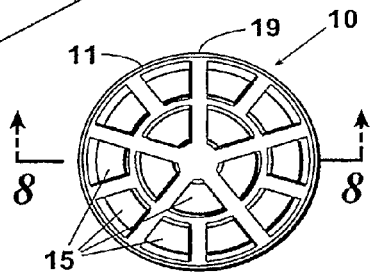
FIG. 7 is a bottom plan view of a typical diamond polishing pad to be stored in the caddy.
Figure 8:
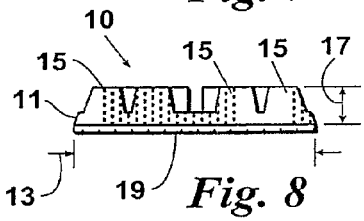
FIG. 8 is a cross-sectional view taken along the line 8-8 of FIG. 7.

The pads 10, seen in FIGS. 4, 7 and 8, have a circular base 11 which tapers upwardly from its greatest diameter 13 to a plurality of studs 15. The base 11 and studs are typically integrally formed phenolic or metallic members with diamond chips (not shown) suspended throughout the height 17 of the studs 15. As shown, a segment of hook-and loop material 19 is adhered to the exposed face of the pad base 11 for securing the pad 10 the grinding machine (not shown). Screws are sometimes used for this purpose. As the pad 10 polishes a surface, the phenolic or metallic face of the pad 10 is worn and the diamond chips grind or polish the surface. The grit of the pads 10 is determined by the size of the chips. As the pads 10 wear, the height 17 of the studs 15 is reduced. A set of pads 10 may have sufficient wear to handle several jobs, but may be removed and replaced between jobs which call for a different grit. To assure proper grinding or polishing, all of the pads 10 in use should be substantially the same height and grit. Once intermingled, the pads 10 of different sets are difficult to sort. The caddy meets this need.

Figure 6:
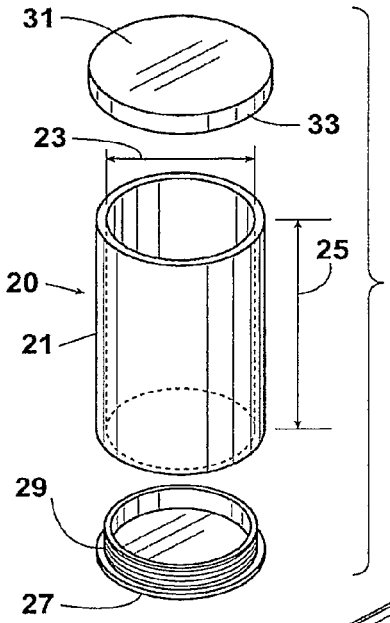
FIG. 6 is a perspective assembly view of the container.
Figure 5:
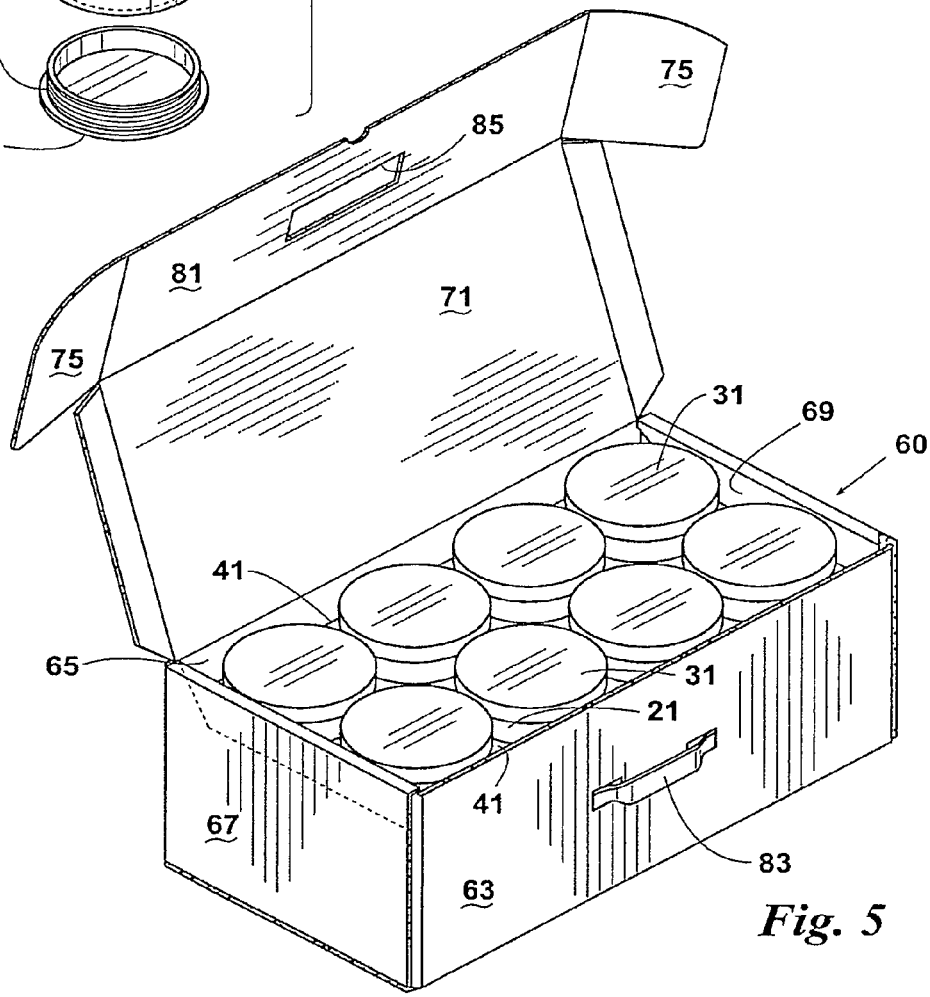
FIG. 5 is a perspective view of the assembled case, rack and containers of the caddy.

Looking at FIG. 6, the containers 20 for storing complete sets of pads 10 are configured to contain the set in a stack. Each container 20 is a cardboard tube of circular cross-section. The container inner diameter 23 slightly greater than the diameter 13 of the pads 10 to be contained, so that the pads 10 can easily slide into and out of their container 20 without any substantial radial movement when the container 20 is in motion. The inside container height 25 is equal to or greater than the height of stack of the pads 10 to be contained when the pads 10 have not been used. The bottom of the tube 21 is closed, preferably by a plastic plug 27 with outer compressible rings 29 to assure a firm engagement of the plug 27 in the tube 21. The upper end of the tube 21 is opened and closed by use of a plastic cap 31 with a rim 33 which grips around the top of the tube 21. As the pads 10 are worn so as to decrease the height of the stack, one or more filler disks 35, perhaps of compressible foam, may be added to the stack to restrict axial motion of the stack components when the container 20 is in motion. While the height 25 of each container 20 is preferably slightly greater than the height of an unused set of the stacked pads 10, taller containers 20 may be used with one or more of the filler disks 35 added to the stack so that the total height of the stack will be approximately equal to, but perhaps less or greater than, the height 25 of the container 20 and, therefore, substantially fill the container 20 when the cap 31 is applied.

As seen in FIGS. 1 and 3-5, the rack 40 is preferably formed from a single piece of cardboard has upper and lower trays 41 and 43 spaced apart by a flap 45 and a riser 47. The lower tray 43 is elevated by flaps 49 on three sides and the upper tray 41 is reinforced by side flaps 51. The trays 41 and 43 have pairs of vertically aligned circular openings 53 and 55, respectively, therethrough, one pair 53 and 55 defining a compartment for each container 20. The compartments orient the containers 20 in an array such that any one of the containers 20 can be independently removed from the rack 40.

Looking at FIGS. 2-5, the case 60 is configured to contain the rack 40 with the containers 20 oriented in their compartments. The case 60 has a bottom wall 61, a front wall 63, a back wall 65, end walls 67 and 69 and a hinged lid 71. The case 60 has an open top 73 through which any one of the containers 20 can be independently removed from the rack 40 and the case 60. In the folded cardboard embodiment, latching flaps 75 and 77 on the front flap 81 of the lid 71 engage between the flaps forming the end walls 67 and 69, respectively, to hold the case 60 in its assembled condition. A carrying handle 83 on the front wall 63 of the case 60 cooperates with an opening 85 on the lid flap 81 to hold the case 60 in a closed condition when the handle 83 is pulled through the opening 85 and gripped by the carrier.

Figure 9:
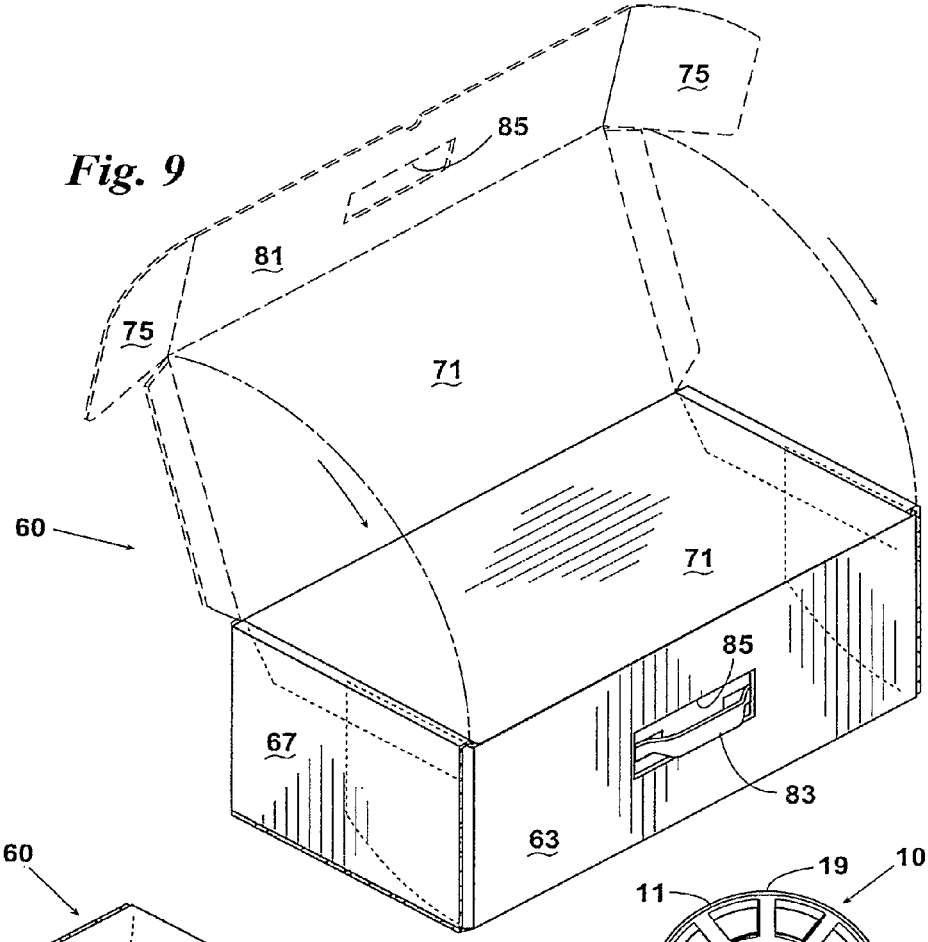
FIG. 9 is a perspective view of the case in its storage orientation.
Figure 10:
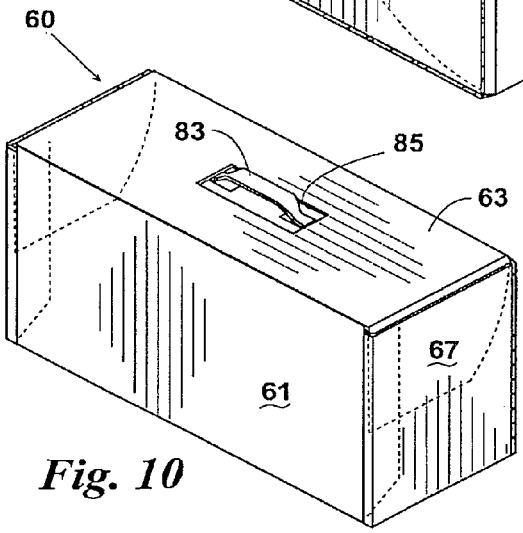
FIG. 10 is a perspective view of the case in its transport orientation.

The rack 40 cooperates with the containers 20 and the case 60 to constrain the containers 20 against Cartesian-directional motion in the case 60. As best seen in FIGS. 9 and 10, the caddy rests on the case bottom wall 61 during storage but is rotated 90 degrees to orient the carrying handle 83 on the case front wall 63 to the top of the case 60 during transport.

Thus, a complete set of stacked pads 10 is stored in each container 20 so that sets of used pads 10 are always sorted and accessible according to both their grit and wear characteristics. The case 60 may be sized to suit any desired number of containers 20 for pads 10 of any height and diameter. The case 60, rack 40, containers 20 and compressible disks 35, if used, are configured with respect to the sets of pads 10 and to each other so as to minimize their relative three dimensional motion during transport of the caddy. The case 60, rack 40 and tube 21 of the containers 20 are preferably made of cardboard so that many sets of pads 10 can be stored and transported in one or more lightweight and inexpensive caddies.

It is, therefore, apparent that there has been provided, in accordance with the invention, a caddy for diamond polishing pads that fully satisfies the objects, aims and advantages set forth above. While the invention has been described in conjunction with a specific embodiment thereof, it will be evident that many alternatives, modifications and variations will be apparent to those skilled in the art and in light of the foregoing description. Accordingly, it is intended to embrace all such alternatives, modifications and variations as fall within the spirit of the appended claims.

What is claimed is:

1. For storing diamond polishing pads used in grinding machines, a caddy comprising:

a plurality of sets of diamond polishing pads, each said set comprising a plurality of pads of such compatible grit, wear, diameter and/or thickness as to promote stable operation of a grinding machine;

a plurality of containers, at least one of said containers containing one said set of said pads in a stack, said at least one of said containers having sidewalls contoured to limit relative lateral motion between said pads contained in said stack; and a rack defining a plurality of compartments, one said compartment for each said container, said plurality of compartments orienting said plurality of containers in an array from which any one of said containers can be independently removed from said rack.

2. A caddy according to claim 1 further comprising a case configured to contain said rack and said containers oriented therein, said case having an open top through which any one of said containers can be independently removed from said rack and said case.

3. A caddy according to claim 2 further comprising a lid covering said open top of said case.

4. A caddy according to claim 3 further comprising a carrying handle on a wall of said case.

5. A caddy according to claim 1, each said container being a tubular member having a closed end and an open end and a cap covering said open end.

6. A caddy according to claim 5, each said container having a height slightly greater than a height of an unused set of said stacked pads.

7. A caddy according to claim 5, each said container being cylindrical.

8. A caddy according to claim 5, each said container having a diameter slightly greater than a diameter of said pads.

9. For storing diamond polishing pads used in grinding machines, a caddy comprising:

a plurality of sets of circular diamond polishing pads, each said set comprising a plurality of pads of such compatible grit, wear, diameter and/or thickness as to promote stable operation of a grinding machine;

a plurality of cylindrical containers, at least one said container containing one said set of said circular diamond polishing pads in a stack, said at least one of said containers having an inner diameter contoured to limit relative lateral motion between said circular pads contained in said stack;

a rack having spaced-apart upper and lower trays, said trays having a plurality of pairs of vertically aligned circular openings therethrough, one said pair for each said container, said plurality of pairs of openings orienting said plurality of containers in an array from which any one of said containers can be independently removed from said rack; and a case having a bottom wall, a front wall, a back wall, end walls and a hinged lid configured to contain said rack and said containers oriented therein, said case having an open top covered by said lid through which any one of said containers can be independently removed from said rack and said case, said rack cooperating with said containers and said case to constrain said containers against Cartesian-directional motion in said case.

10. A caddy according to claim 9 further comprising a carrying handle on said front wall of said case.

11. A caddy according to claim 9, each said container having upper and lower open ends.

12. A caddy according to claim 11 further comprising a plug closing said lower open end.

13. A caddy according to claim 12 further comprising a cap covering said upper open end.

14. A caddy according to claim 9, each said container having a diameter slightly greater than a diameter of said pads.

15. A caddy according to claim 9, each said container having a height slightly greater than a height of a new said set of stacked pads.

16. A caddy according to claim 15 further comprising a compressible disk stackable with said pads, said disk having a height such that the height of said stack is at least equal to said height of said container.

17. A caddy according to claim 9, said rack being formed from a single folded sheet of cardboard.

18. A caddy according to claim 9, said case being formed from a single folded sheet of cardboard.

* * * * *